United States Patent [19]

Sippola

[11] Patent Number: 4,752,508

[45] Date of Patent: Jun. 21, 1988

[54] METHOD FOR CONTROLLING THE THICKNESS OF AN INTERMETALLIC (FE-ZN PHASE) LAYER ON A STEEL STRIP IN A CONTINUOUS HOT-DIP GALVANIZING PROCESS

[75] Inventor: Pertti J. Sippola, Espoo, Finland

[73] Assignee: Rasmet Ky, Finland

[21] Appl. No.: 20,106

[22] Filed: Feb. 27, 1987

[51] Int. Cl.[4] ..... C23C 2/06

[52] U.S. Cl. ..... 427/433; 427/431

[58] Field of Search ..... 427/433, 431

[56] References Cited

U.S. PATENT DOCUMENTS 4,082,869 4/1978 Raymond ..... 427/433

4,361,448 11/1982 Seppolg ..... 427/433

FOREIGN PATENT DOCUMENTS 0083754 5/1984 Japan ..... 427/433

*Primary Examiner*—Sam Silverberg

*Attorney, Agent, or Firm*—Scully, Scott, Murphy & Presser

[57] ABSTRACT

The present invention relates to a method for controlling the thickness of an intermetallic layer (Fe-Zn phase) on a steel strip in a continuous hot-dip galvanizing line. The steel strip is rapidly cooled by quenching in a zinc bath and the structure of the coating to be formed on the steel strip is controlled by directing a flow of molten zinc, cooled to a temperature 1° to 15° C. below the operating temperature of the zinc bath, towards the steel strip. At least a part of said flow is preferably directed towards the steel strip close to its immersion point into the zinc bath, obliquely against the movement direction of the steel strip.

5 Claims, 2 Drawing Sheets

THERMAL CYCLE $T_1$ = ANNEALING TEMPERATURE (700-850°C)
$T_2$ = PREQUENCHING TEMPERATURE (600-700 °C)
$T_3$ = END POINT OF RAPID COOLING
(TIME = $T_2 - T_3$ IS 0.5 SECONDS)

METHOD FOR CONTROLLING THE THICKNESS OF AN INTERMETALLIC (FE-ZN PHASE) LAYER ON A STEEL STRIP IN A CONTINUOUS HOT-DIP GALVANIZING PROCESS

A cold-rolled steel strip can be given a good formability by means of a heat treatment disclosed in my earlier U.S. Pat. No. 4,361,448. After annealing at a temperature $T_1$ (720° to 850° C.), the steel strip is slowly cooled to a temperature $T_2$ (600° to 650° C.), from which temperature it is rapidly quenched in a zinc bath to a temperature $T_3$. The time interval between $T_2$ and $T_3$ is about 0.5 seconds.

In the arrangement of the U.S. Pat. No. 4,361,448 a zinc bath cooler and a zinc pump, with nozzles, are separate units. Molten metal having the same temperature as the zinc bath is pumped through a snout to the immersion point of the steel strip. Therefore the end temperature $T_3$ of the rapid cooling is rather high, and the steel strip does not reach the temperature of the zinc bath during the entire immersion time (about two seconds).

A steel strip travelling through a zinc bath causes a laminar zinc flow following the surface of the steel strip. The heat from inside the steel strip raises the temperature of the laminar zinc flow (layer) to a value higher than the operating temperature of the zinc bath. Since iron and zinc react strongly in a conventional zinc bath (containing 0.15 to 0.25% aluminium) at temperature above 480° C., the result is that a thick intermetallic layer is formed on the zinc coating.

In order to achieve a good formability of the zinc coating, the intermetallic layer should be as thin as possible. In the method according to the invention, the thickness of the intermetallic layer is controlled by lowering the temperature of the zinc flow introduced through the nozzles below the operating temperature of the bath, preventing the temperature of the zinc in said laminar zinc flow from rising, by lowering the temperature $T_3$ as low as possible by means of a zinc flow directed perpendicularly to the steel strip.

Specific features of the invention are stated in the claims and appear likewise from the following description with reference to the enclosed drawing.

FIG. 1 is a thermal diagram illustrating the heat treatment disclosed in the U.S. Pat. No. 4,361,448.

FIGS. 1 and 2 are shown to facilitate the understanding of the prior art such as discussed in the beginning of the specification and to by comparison illustrate the advantages which are achieved by the present invention.

Figure 1:
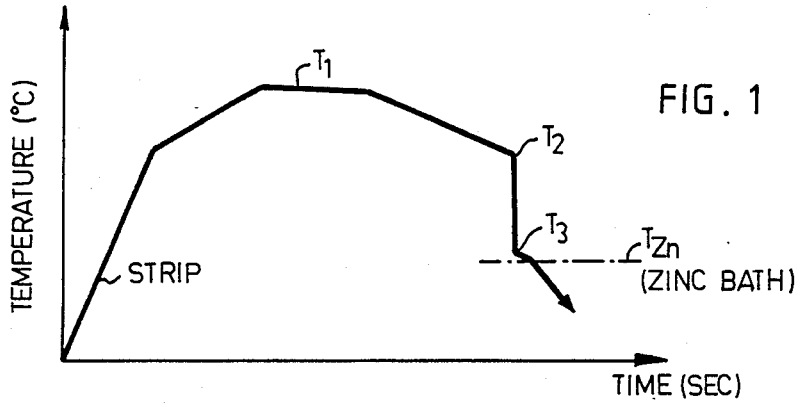
Figure 3:
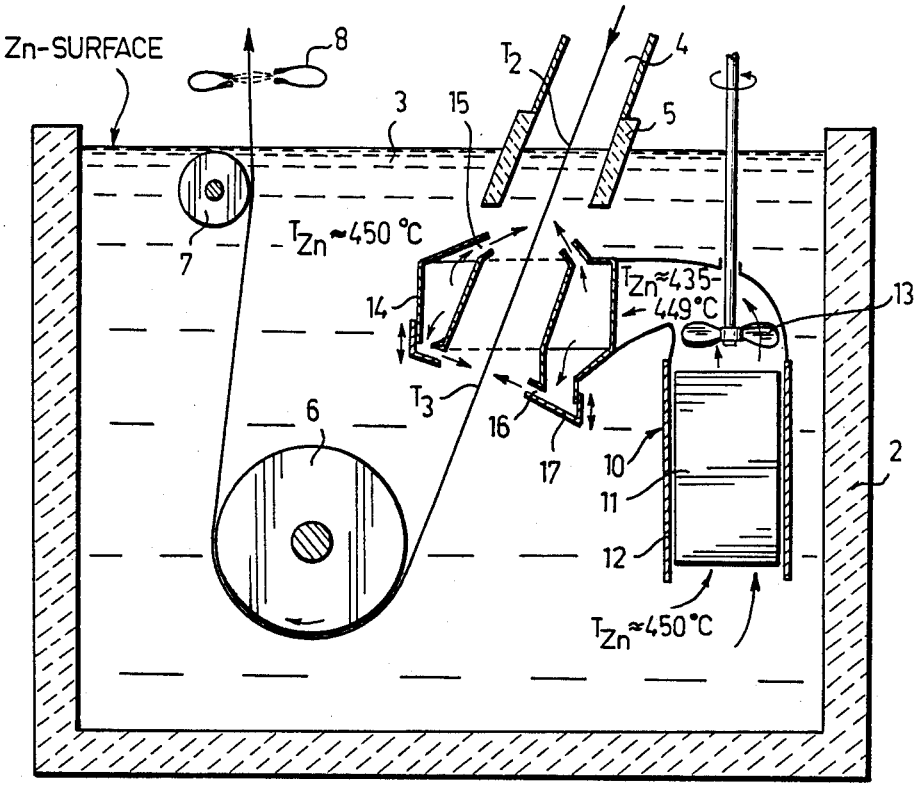
FIG. 3 shows schematically the zinc bath arrangement of the invention, in a longitudinal section.

FIG. 3 shows the new zinc bath arrangement. Reference numeral 1 indicates a continuous step strip, with a thickness of e.g. 1 mm, 2 indicates a pot for a bath 3 of molten zinc with an aluminium content up to about 5%. 4 indicates an end chute of the last zone of a soaking furnace wherein the temperature of the steel is controlled to the temperature $T_2$ (FIG. 1), 5 indicates a snout which may be water cooled, 6 and 7 indicate guide rolls within the zinc bath which rolls can be used for regulating the galvanizing time in a known manner, e.g. by adjusting the roll 6 vertically. Reference numeral 8 indicates gas jet nozzles.

Figure 2:
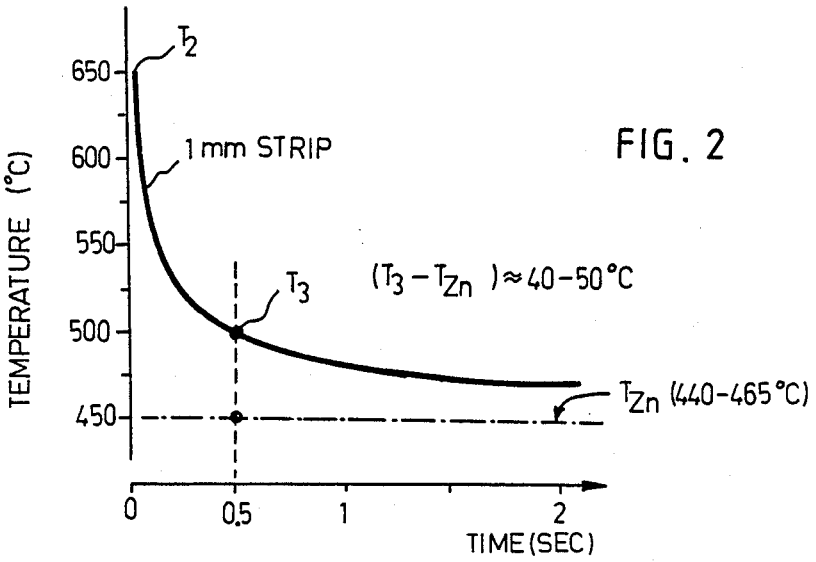
FIG. 2 is a diagram illustrating the cooling (quenching) step in a zinc bath, in the treatment of FIG. 1, for a steel strip having a thickness of 1 mm.

So far the arrangement of FIG. 3 corresponds to FIG. 2 of the U.S. Pat. No. 4,361,448. The treatment steps before the chute 4 and after the gas jet nozzles 8 belong likewise to the prior art, reference can again be made e.g. to FIG. 2 of the U.S. Pat. No. 4,361,448.

The novelty of the zinc bath arrangement shown in FIG. 3, by means of which the present method is carried out, is a specific apparatus for circulating cooled molten zinc towards the steel strip 1 at its immersion into the zinc bath, this apparatus being generally designated by the reference numeral 10. 11 indicates a cooler, 12 indicates a duct surrounding the cooler 11 and a circulation pump 13 after the cooler 11. 14 indicates a nozzle unit with upper nozzles 15 and lower nozzles 16. A bottom part 17 is mounted adjustably to the unit 14 (vertical arrows); a similar arrangement may be provided at the upper nozzles 15.

The zinc bath cooler 11, the zinc pump 13 and the nozzles 15, 16 form an integral unit, so that the temperature of the zinc flowing through the cooler can be lowered 1° to 15° C. below the operating temperature of the zinc bath. The nozzles 15 direct the zinc flow obliquely towards the steel strip, preferably against the travel direction thereof, preventing the warming of the zinc within the snout 5 and the formation of zinc vapors in the furnace 4. The nozzles 16 direct the zinc flow e.g. perpendicularly towards the steel strip. The nozzles are preferably adjustable so that the volume flows of the different nozzles can be varied. The total amount of the zinc flow can be controlled by means of the speed of rotation of the pump 13.

Figure 4:
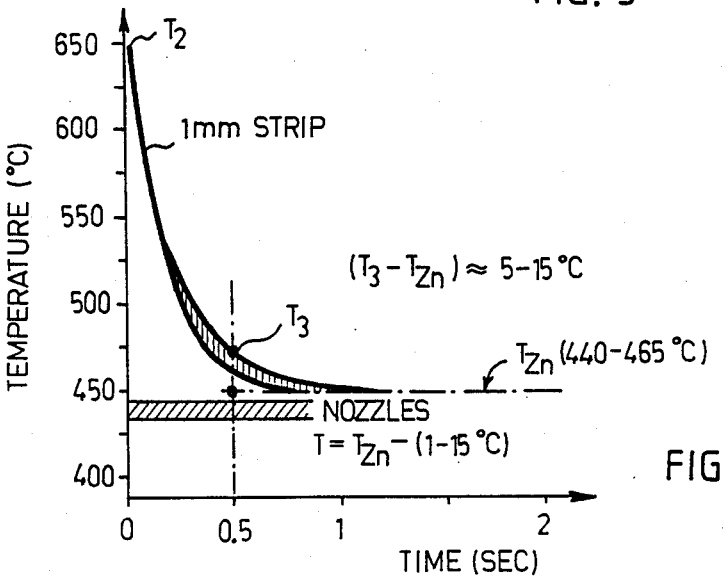
FIG. 4 is a diagram illustrating the cooling (quenching) step according to the invention.

The temperature $T_3$ of the steel strip, i.e. the end temperature of the rapid cooling, can be reduced and/or controlled by means of the method according to the invention in a manner illustrated in FIG. 4. Provided that $T_3$ is as close as possible to the operating temperature of the zinc bath, e.g. 450° C., the formation of an intermetallic layer, disadvantageous to the forming operation on the zinc coating, is prevented nearly completely in a conventional zinc bath (having an aluminium content of 0.15 to 0.25%). Accordingly, the thickness of an intermetallic layer on the zinc coating of a steel strip can be controlled by varying the temperature of the zinc bath between 440° C. and 465° C. and by adjusting the difference between the temperature $T_3$ and the temperature of the zinc bath, if the temperature of an incoming steel strip exceeds 550° C. before the zinc bath.

When the aluminium content of the zinc-aluminium bath is about 5%, the operating temperature can be kept between 415° C. and 425° C., so that the method according to the invention makes it possible to reduce the end temperature of the rapid cooling of the steel strip to a value considerably below 450° C. This improves the quality of the coating, because the rapid cooling makes the eutetic alloyed coating fine-granular. In addition, the formation of uncoated spots is prevented by the high steel strip temperature in spite of the high surface tension of the zinc alloy.

What is claimed is:

1. A method for controlling the thickness of an intermetallic (Fe—Zn phase) layer on a steel strip in a continuous hot-dip galvanizing line, comprising the steps of rapidly cooling the steel strip by quenching it in a bath of molten zinc, the temperature of steel strip, when introduced into the zinc bath, being considerably more than 100° C. above the operating temperature of the zinc bath, and controlling the structure of the coating to be formed on the steel strip by regulating the end temperature of the steel strip in the quenching by directing, by means of first nozzles, a flow of molten zinc, cooled to a temperature below the operating temperature of the zinc bath, towards the steel strip close to the immersion point thereof and obliquely against the movement direction of the steel strip as it moves through the zinc bath and directing, by means of second nozzles, a second flow of cooled molten zinc directed at least essentially perpendicularly towards the steel strip at a point after said obliquely directed flow.

2. A method according to claim 1 wherein the temperature of the cooled zinc flow towards the steel strip is 1° to 15° C. below the operating temperature of the zinc bath.

3. A method according to claim 1 wherein the flow of cooled zinc is directed towards the steel strip evenly over the width thereof and from both sides.

4. A method according to claim 1 wherein the said first and second nozzles directing the flow of cooled zinc towards the steel strip are individually adjustable.

5. A method according to claim 1 wherein the flow molten zinc directed towards the steel strip is cooled by means of a heat exchanger cooler, the flow of zinc through the cooler to said nozzle being separated from the rest of the zinc bath.

* * * * *